US006604938B1

(12) United States Patent
Blaauwwiekel et al.

(10) Patent No.: US 6,604,938 B1
(45) Date of Patent: Aug. 12, 2003

(54) DEVICE FOR GAS BURNERS

(75) Inventors: Piet Blaauwwiekel, Sleen (NL); Albert Hietkamp, Emmen (NL)

(73) Assignee: Honeywell B.V., Amsterdam (NL)

( * ) Notice: Subject to any disclaimer, the term of this patent is extended or adjusted under 35 U.S.C. 154(b) by 0 days.

(21) Appl. No.: 10/009,371

(22) PCT Filed: May 25, 2000

(86) PCT No.: PCT/EP00/04756

§ 371 (c)(1),
(2), (4) Date: Apr. 11, 2002

(87) PCT Pub. No.: WO00/75566

PCT Pub. Date: Dec. 14, 2000

(30) Foreign Application Priority Data

Jun. 4, 1999 (DE) ..... 199 25 567

(51) Int. Cl.[7] ..... F23N 5/00; F61K 21/04

(52) U.S. Cl. ..... 431/18; 431/62; 431/89; 137/895; 137/513.7

(58) Field of Search ..... 431/12, 18, 62, 431/89; 137/895, 513.7

(56) References Cited

U.S. PATENT DOCUMENTS 4,417,868 A * 11/1983 Putnam ..... 431/1
5,799,831 A * 9/1998 Spriggs et al. ..... 222/132
6,206,687 B1 * 3/2001 Redington ..... 431/90
6,375,454 B1 * 4/2002 Jacobsen et al. ..... 431/1

FOREIGN PATENT DOCUMENTS

| | | | |
|---|---|---|---|
| DE | 2305764 | * | 8/1974 |
| DE | 19728965 | * | 1/1998 |
| DE | 19635974 | * | 3/1998 |
| JP | 58182031 | * | 10/1983 |
| JP | 63025413 | * | 2/1988 |

OTHER PUBLICATIONS

International Search Report of PCT/EP 00/04756.*

* cited by examiner

*Primary Examiner*—Alfred Basichas

(57) ABSTRACT

The invention relates to a device for gas burners, comprising at least two air nozzles 10, 11 for combustion air.

Figure 1:
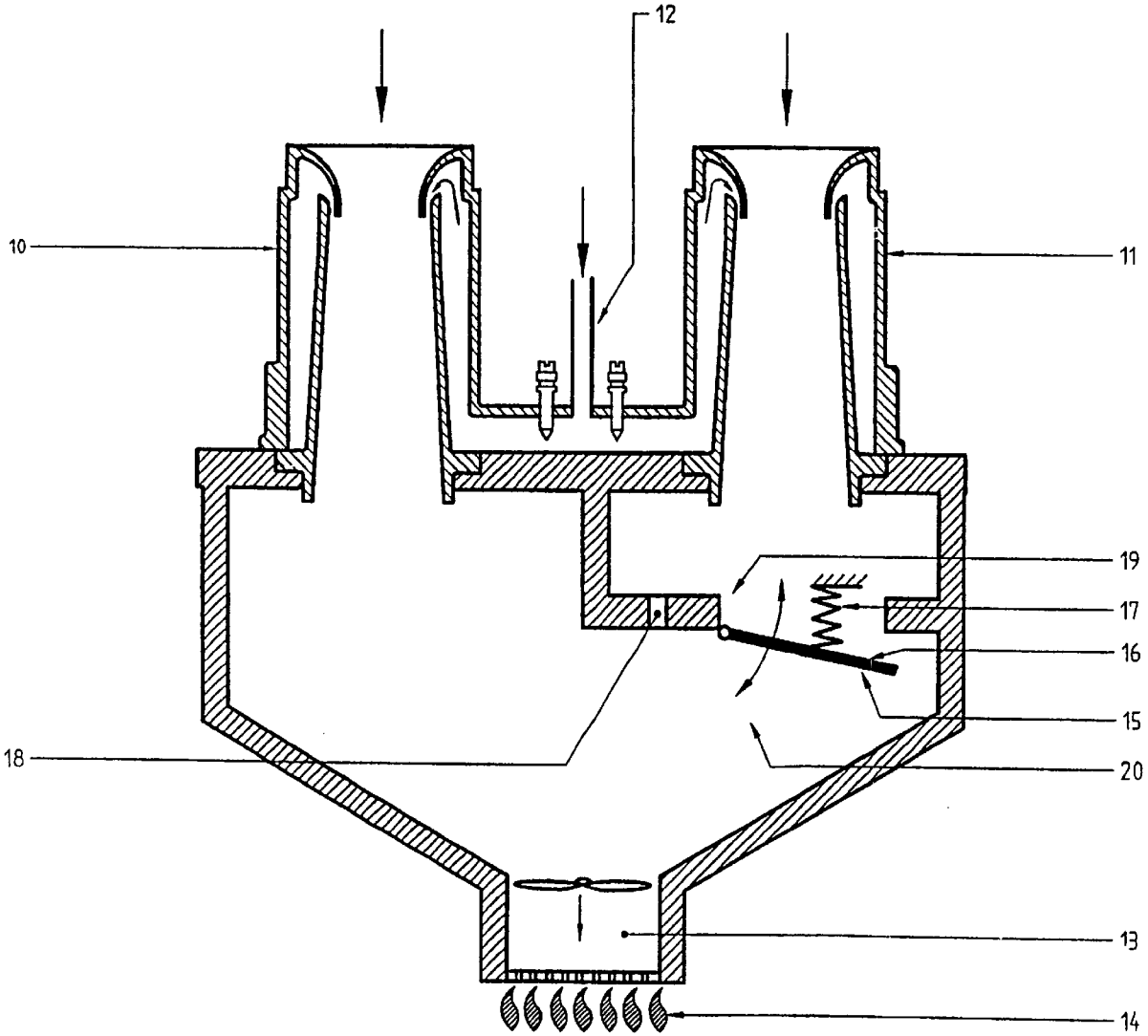

The air nozzles 10, 11 are arranged in parallel. According to the invention, a flow restrictor 15 is assigned to one or more of the air nozzles 10, 11, respectively. Each of these flow restrictor 15 is capable of selectively shutting off the flow of air through the respective air nozzle 10, 11. This increases the range of modulation of the device according to the invention.

8 Claims, 2 Drawing Sheets

DEVICE FOR GAS BURNERS

The invention relates to a device for gas burners comprising a plurality of air nozzles for combustion air according to the preamble of claim 1.

A device according to the prior art is known from the DE Utility Model 298 01 429. In the device shown there, combustion air is moved through air nozzles arranged in parallel, with the minimum capacity and, thus, the lower modulation range of the device being determined by the sum of the minimum capacities of all air nozzles arranged in parallel. This lower modulation range restricts the range of application of such devices according to the prior art. Further devices according to the prior art are known from the JP 57-188917A, the JP 57-31716A, the DE 197 28 965 A1 and the FR 758 974.

Proceeding therefrom, the present invention is based on the problem of creating a device for gas burners which comprises a plurality of air nozzles for combustion air and has a larger modulation range and, thus, a greater range of application.

This problem is solved by a device comprising the features of claim 1.

Further advantageous embodiments of the invention result from the subclaims and the description. In the following, preferred embodiments of the invention will be explained in greater detail by means of the drawing. In the drawing FIG. 1 shows a schematic sectional representation of an inventive device according to a first embodiment of the invention; and FIG. 2 shows a modulation diagram for an inventive device according to a second embodiment of the invention.

Figure 2:
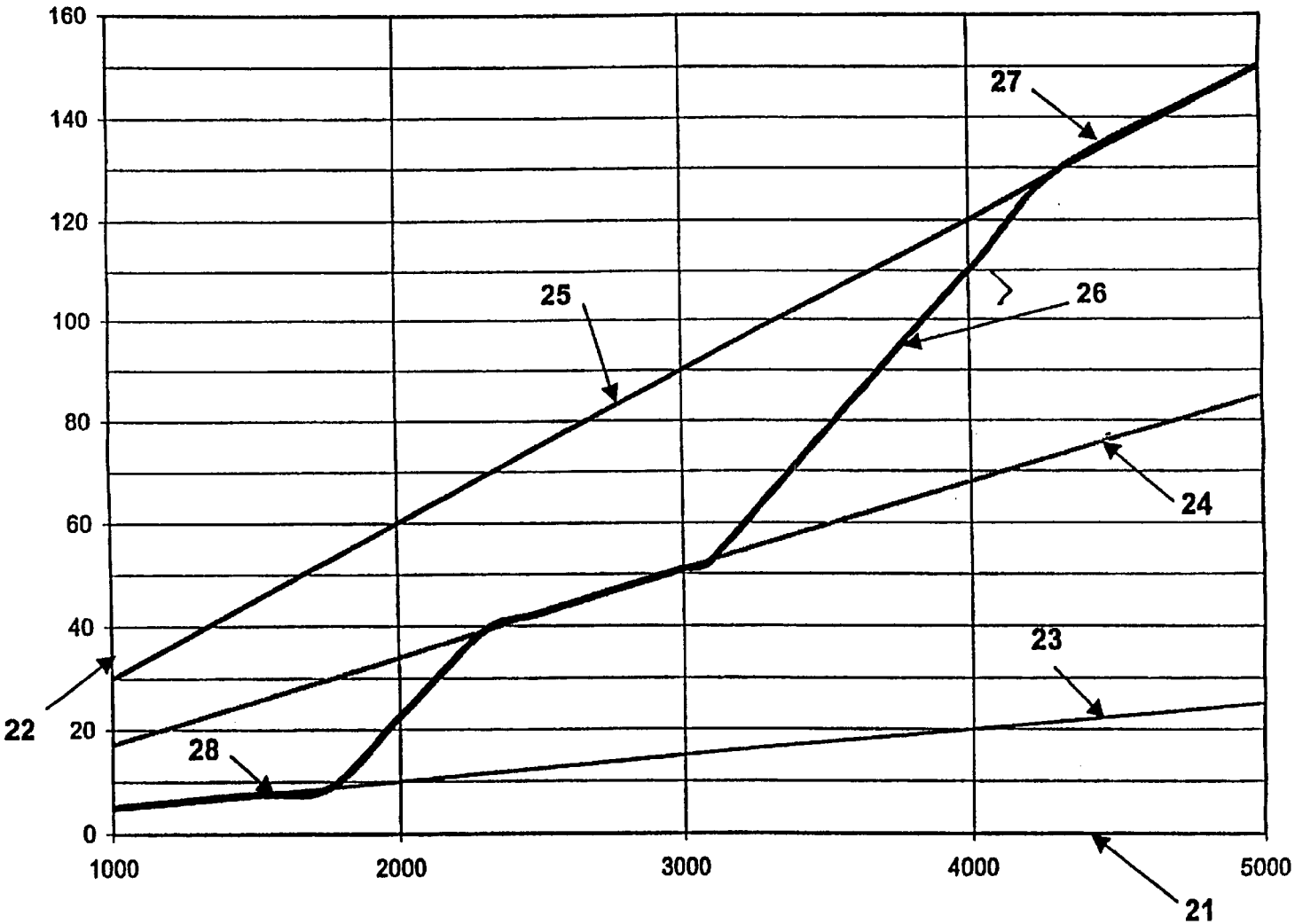

FIG. 1 shows a first embodiment of a device according to the invention, the device comprising two air nozzles 10, 11 and a gas nozzle 12, with the flow of gas flowing through the gas nozzle 12 being mixed with the flows of combustion air flowing through the air nozzles 10, 11 and leaving the device according to the invention through a mixture outlet 13 in the direction of a gas burner of which the flames 14 are shown.

The two air nozzles 10, 11 of the embodiment according to FIG. 1 are, on the one hand, formed as Venturi nozzles and, on the other hand, connected with each other in parallel. In a device of that kind according to the prior art, this would mean that the minimum capacity of the device and its lower modulation range, respectively, is determined by the sum of the minimum capacities of the two air nozzles 10, 11.

In order to further decrease the minimum capacity and, thus, lower the modulation range of the device, a flow restrictor 15 is assigned to the air nozzle 11 in the embodiment shown in FIG. 1; this flow restrictor 15 is capable of shutting off the air flow through the air nozzle 11. Thus, when the air flow through the air nozzle 11 is shut off, combustion air is moved only through the air nozzle 10 and, consequently, the lower modulation range of the device according to the invention is shifted towards the minimum capacity of the air nozzle 10.

In the embodiment represented in FIG. 1, the flow restrictor 15 is formed as a flap 16 having a spring member 17 assigned thereto. The strength of the elastic force of the spring member 17 as well as the design or construction of the flap 16 determines the blocking characteristic of the flow restrictor 15. This means, if the air flow through the air nozzle 10 falls below a certain value, the force exerted by this air flow on the flap 16 does no longer suffice to hold the flap 16 open against the elastic force of the spring member 17. Then, the flap 16, i.e. the flow restrictor 15, is closed.

In this connection, it is also of importance that the air nozzle 11 to which the flow restrictor is assigned is also assigned a bypass 18. This bypass 18 extends from an inlet side 19 to an outlet side 20 of the flow restrictor 15. By the bypass 18, it is guaranteed that even when the flow restrictor 15 is closed, a reduced flow of combustion air is moved from the air nozzle 11 in the direction of the burner which is not represented in detail. In this way, when the flow restrictor 15 is closed, gas is prevented from emerging through the air nozzle 11 as a result of a pressure difference.

In the embodiment represented in FIG. 1, the air nozzles 10, 11 differ with respect to their characteristic curve. The air nozzle 10 has a smaller capacity than the air nozzle 11 and, thus, a minimum capacity.

In the embodiment represented in FIG. 1, both air nozzles 10, 11 are supplied with gas via a gas nozzle 12. Deviating from this embodiment as shown, it is also possible to assign a separate gas nozzle to each air nozzle 10, 11. In this case, when the flow restrictor 15 of the air nozzle 11 is closed, also the gas nozzle assigned to this air nozzle 11 has to be closed. This means, an additional flow restrictor would then be required.

In the embodiment shown in FIG. 1, the closing of the flow restrictor 15 depends on the flow of air through the air nozzle 11. This could be called a combustion air modulation. Instead of this, also an actuator which closes the flow restrictor 15 could be used. Such an actuator could, for instance, open or close the flow restrictor 15 in dependence on certain load levels.

It goes without saying that the principle described in FIG. 1 can be extended to devices comprising an arbitrary number of air nozzles arranged in parallel. A flow restrictor is then assigned to each air nozzle with the exception of the air nozzle with the smallest characteristic curve. The air nozzle with the smallest characteristic curve would thus always be open. When closing one or more air nozzles, the open air nozzles operate further, thus allowing the modulation range of the device according to the invention to be extended.

FIG. 2 shows a modulation diagram for an inventive device according to a second embodiment of the invention in which three air nozzles are arranged in parallel. In the modulation diagram of FIG. 2, the rotational speed of the ventilator is indicated on the X-axis 21 in revolutions per minute and the heat load is indicated on the Y-axis 22 in kilowatt. The line 23 in FIG. 2 corresponds to the modulation graph of a single air nozzle, the line 24 to the modulation graph of two air nozzles arranged in parallel, and the line 25 to the modulation graph of three air nozzles arranged in parallel without the respective flow restrictor according to the invention. In this case, this would mean that the lower modulation limit of a device consisting of three air nozzles arranged in parallel is determined by the sum of the minimum capacities of all three air nozzles (line 25).

Moreover, FIG. 2 shows by line 26 a modulation graph of an inventive device consisting of three air nozzles, with two air nozzles each being assigned a flow restrictor. In the range 27 of the full-load-operation, the ventilator runs at high rotational speeds; thus, the flow restrictor are open and combustion air flows through all three air nozzles. If the rotational speed of the ventilator is reduced, the flow restrictor assigned to the air nozzles with the higher characteristic curve are closed one after the other, and finally only the air nozzle with the smallest minimum capacity is open in the range 28 of the minimum-load operation. In this way, the modulation range of the device according to the invention can thus be increased towards small loads.

In this connection, it is to be remarked that, purely theoretically, also in devices according to the prior art, the modulation range can be lowered by more and more reducing the rotational speed of the ventilator. However, in this connection, there arises the physical problem that when the rotational speed of the ventilator is more and more reduced, the pressure difference generated at the air nozzles becomes very low and, thus, a stable control signal is no longer available. Insofar, a stable control signal for small operational loads can only be made available by means of the device according to the invention. Only by the device according to the invention can the modulation range thus be extended so as to achieve stable control signals.

What is claimed is:

1. A device for gas burners, comprising:

at least two air nozzles for combustion air;

at least one gas nozzle assigned to the air nozzles; and at least one flow restrictor assigned to at least one of the air nozzles, wherein each flow restrictor is capable of selectively shutting off the flow of air through the respective air nozzle.

2. The device of claim 1, wherein:

the flow restrictor is formed as a flap having a spring member attached thereto.

3. The device according to claim 1, wherein:

at least one of the air nozzles differs from any other air nozzle with respect to its characteristic curve.

4. The device according to claim 3, wherein all air nozzles differ from each other with respect to their characteristic curve.

5. The device according to claims 4, wherein each of the air nozzles except the air nozzle with a smallest characteristic curve is assigned a flow restrictor.

6. The device according to one or more of claims 5, wherein each air nozzle to which a flow restrictor is assigned is also assigned a bypass.

7. The device according to claim 6, wherein each bypass extends between an inlet side and an outlet side of the respective flow restrictor.

8. The device according to claim 1, wherein the air nozzles are formed as venturi nozzles.

* * * * *